US008191503B2

(12) United States Patent
Kusunoki

(10) Patent No.: US 8,191,503 B2
(45) Date of Patent: Jun. 5, 2012

(54) LIQUID APPLICATION APPARATUS AND METHOD, AND IMAGE FORMING APPARATUS

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 512 days.

(21) Appl. No.: 12/402,703

(22) Filed: Mar. 12, 2009

(65) Prior Publication Data

US 2009/0232997 A1 Sep. 17, 2009

(30) Foreign Application Priority Data

Mar. 14, 2008 (JP) ..... 2008-066436

(51) Int. Cl.
*B05C 17/02* (2006.01)

(52) U.S. Cl. ..... 118/681; 118/211; 118/212; 118/259; 118/262; 118/410; 347/84; 347/85; 347/101; 347/103

(58) Field of Classification Search ..... 118/211, 118/212, 259, 260, 261, 262, 46, 300, 419, 118/410, 681; 347/84, 85, 101, 103; 101/416.1, 101/423, 424.2, 147, 148; 427/428.13, 428.2, 427/428.21

See application file for complete search history.

(56) References Cited

U.S. PATENT DOCUMENTS 4,246,868 A * 1/1981 Brown et al. ..... 118/694
4,949,667 A * 8/1990 Yoshida et al. ..... 118/60
5,755,883 A * 5/1998 Kinose et al. ..... 118/110
6,183,079 B1 * 2/2001 Meade et al. ..... 347/101
6,585,364 B2 * 7/2003 Kasperchik et al. ..... 347/98
2002/0132054 A1 * 9/2002 Trautman et al. ..... 427/372.2
2009/0232998 A1 * 9/2009 Krebs ..... 427/428.2

FOREIGN PATENT DOCUMENTS

JP 2007-83180 A 4/2007

OTHER PUBLICATIONS

Rolltech Col. Ltd., www.rolltech.jp/furekiso.htm, 12 pages, searched Jan. 24, 2008.

* cited by examiner

*Primary Examiner* — Laura Edwards
(74) *Attorney, Agent, or Firm* — Birch, Stewart, Kolasch & Birch, LLP

(57) ABSTRACT

A liquid application apparatus includes: an application roller having an application surface for applying a liquid to a medium, at least the application surface of the application roller being constituted by an elastic body; a liquid holding unit including an abutting part which abuts against a circumferential surface of the application roller so as to form a liquid holding space, the abutting part including a measuring roller which has a projection-recess surface capable of holding a specific amount of the liquid; and a drive control device which rotates the application roller and the measuring roller in such a manner that the liquid is transferred from the application surface to the medium while the liquid is supplied to the application surface from the liquid holding unit, and which halts rotation of the measuring roller while rotating the application roller after an end of application of the liquid to the medium.

8 Claims, 12 Drawing Sheets

LIQUID APPLICATION APPARATUS AND METHOD, AND IMAGE FORMING APPARATUS

BACKGROUND OF THE INVENTION

1. Field of the Invention

The present invention relates to a liquid application apparatus and method, and more particularly to liquid application technology which is suitable as a device for depositing treatment liquid on a recording medium with an object of promoting aggregation of coloring material or the like, prior to ejecting ink droplets in an inkjet recording apparatus, and to an image forming apparatus which uses this technology.

2. Description of the Related Art

In recent years, in order to achieve high quality in an inkjet recording apparatus, it has been proposed that a treatment liquid such as an aqueous solution of a polyvalent metal salt, or an acidic aqueous solution, or the like, be deposited on a recording medium before ejecting droplets of ink, and caused to react with the ink. As a liquid application mechanism for applying this treatment liquid to the recording medium, Japanese Patent Application Publication No. 2007-83180 discloses a liquid application apparatus which comprises: an application roller that rotates in contact with a recording medium, and a liquid holding member which holds an application liquid in a liquid holding space formed between the roller surface and itself by abutting against the circumferential surface (application surface) of the application roller.

The liquid application apparatus described in Japanese Patent Application Publication No. 2007-83180 is based on a mechanism which supplies an application liquid to the circumferential surface of an application roller from a liquid holding space by rotating the application roller, while transferring the application liquid to a recording medium, and in order to prevent the evaporation of the application liquid held in the liquid holding member, a structure is adopted in which abutting members (sliding seal members) having a low sliding friction are provided against the rotating circumferential surface of the application roller in the portions corresponding to the inlet (return side) and the outlet.

However, there is a problem with the structure disclosed in Japanese Patent Application Publication No. 2007-83180 in that the liquid volume which is taken out onto the circumferential surface of the application roller from the liquid holding space of the liquid holding member due to the rotation of the application roller is arbitrary, and the application volume is not stable. Furthermore, when the printing operation is halted (off), there is a possibility that the soluble fractions separate from the liquid adhering to the surface of the application roller which has not been applied.

Moreover, of the application liquid deposited on the surface of the application roller, the application liquid in an untransferred state which is left on the roller rather than being transferred to the recording medium makes contact with the abutting member on the return side of the liquid holding member, and hence there is a possibility that the application liquid collects on the contacting portion on the return side and overflows.

SUMMARY OF THE INVENTION

The present invention has been contrived in view of the foregoing circumstances, an object thereof being to provide a liquid application apparatus and method, and an image forming apparatus using same, whereby the application volume can be stabilized, the separation of the soluble components from the liquid can be effectively avoided, and the returning liquid can be recovered.

In order to attain an object described above, one aspect of the present invention is directed to a liquid application apparatus comprising: an application roller having an application surface for applying a liquid to a medium, at least the application surface of the application roller being constituted by an elastic body; a liquid holding unit including an abutting part which abuts against a circumferential surface of the application roller so as to form a liquid holding space from which the liquid is supplied to the application surface, the abutting part having a measuring roller which is situated on a downstream side in terms of a direction of rotation of the application roller and has a projection-recess surface capable of holding a specific amount of the liquid; and a drive control device which rotates the application roller and the measuring roller in such a manner that the liquid is transferred from the application surface to the medium while the liquid is supplied to the application surface from the liquid holding unit, and which halts rotation of the measuring roller while rotating the application roller after an end of application of the liquid to the medium.

According to this aspect of the invention, a uniform volume of liquid is supplied to the application surface of the application roller by the measuring roller, and therefore it is possible to stabilize the volume of liquid applied to the medium. Furthermore, by rotating the application roller while halting the measuring roller and thus halting the supply of liquid to the application surface when the application of liquid has been completed, it is possible to recover the liquid remaining on the roller surface into the liquid holding unit. In this way, it is possible to prevent the liquid that has not been transferred to the medium from precipitating (from causing separation of a dissolved substance) on the surface of the application roller.

Here, a "medium" is a general term for a medium which receives the application of liquid, and this term includes, for instance, a print medium in an inkjet recording apparatus, an image forming medium, a recording medium, an image receiving medium, an ejection receiving medium, an intermediate transfer body, and the like. There are no particular restrictions on the shape or material of the medium, which may be various types of media, irrespective of material and size, such as continuous paper, cut paper, sealed paper, resin sheets, such as OHP sheets, film, cloth, a printed circuit substrate on which a wiring pattern, or the like, is formed, a rubber sheet, a metal sheet, or the like.

Desirably, the liquid application apparatus further comprises: a drive device which drives the application roller to rotate; and a brake device which restricts the rotation of the measuring roller, wherein the measuring roller rotates following the rotation of the application roller when a braking action by the brake device is released.

According to this aspect of the invention, it is not necessary to provide a device (motor or transmission mechanism) which drives the measuring roller to rotate independently, and hence the rotational driving of the measuring roller can be controlled by means of a simple structure.

Desirably, after the end of the application of the liquid to the medium, the drive control device causes the application roller to rotate at least by 360 degrees in a state where the rotation of the measuring roller is halted.

According to this aspect of the invention, it is possible to recover the untransferred liquid on the surface of the application roller into the liquid holding unit, in a reliable fashion.

Desirably, the measuring roller is a roller whose surface has cells for holding the liquid, or a roller whose surface has a groove for holding the liquid.

It is suitable to use a roller with cells or a roller with a spiral groove as the measuring roller in the liquid holding unit.

Desirably, the abutting part of the liquid holding unit includes a recovery roller which is situated on an upstream side in terms of the direction of the rotation of the application roller and has a projection-recess surface capable of holding a specific amount of the liquid.

According to this aspect of the invention, it is possible reliably to recover the untransferred liquid which is adhering to the application surface of the application roller and which is returned to the liquid holding unit, into the liquid holding space by means of the recovery roller, and therefore collection of liquid or overflowing thereof in the return section can be prevented.

Desirably, the recovery roller is a roller whose surface has cells for holding the liquid, or a roller whose surface has a groove for holding the liquid.

In order to attain an object described above, another aspect of the present invention is directed to an image forming apparatus, comprising: one of the liquid application apparatuses described above which apply a first liquid to a medium; and a liquid ejection head which ejects droplets of a second liquid to the medium to which the first liquid has been applied by the liquid application apparatus.

The "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, and the like.

Desirably, the second liquid is an ink containing coloring material, and the first liquid is an aggregating agent which causes the coloring material to aggregate.

According to this aspect of the invention, it is possible to improve the accuracy of the volume of aggregating agent applied, and image non-uniformities, or the like, caused by non-uniformities in the aggregating agents can be prevented, thus enabling the formation of high-quality images. An inkjet recording apparatus according to one mode of the image forming apparatus comprises: a liquid ejection head (which is equivalent to a "recording head") having a liquid nozzle(s) ejecting an ink droplets in order to form dots and a pressure generating device (a piezoelectric element, a heating element, or the like) which generates an ejection pressure; and an ejection control device which controls the ejection of liquid droplets from the recording head on the basis of ink ejection data generated from the image data. An image is formed on a recording medium by means of the liquid droplets ejected from a nozzle.

In order to attain an object described above, another aspect of the present invention is directed to a liquid application method of applying a liquid to a medium by using a liquid application apparatus comprising: an application roller having an application surface for applying a liquid to a medium, at least the application surface of the application roller being constituted by an elastic body; and a liquid holding unit including an abutting part which abuts against a circumferential surface of the application roller so as to form a liquid holding space from which the liquid is supplied to the application surface, the abutting part having a measuring roller which is situated on a downstream side in terms of a direction of rotation of the application roller and has a projection-recess surface capable of holding a specific amount of the liquid, wherein when applying the liquid to the medium, the liquid application method comprises the step of applying a rotational drive force to the application roller so as to rotate the application roller and the measuring roller in a state where the application surface to which the liquid is applied is placed in contact with the medium, in such a manner that the liquid is transferred from the application surface to the medium while the liquid is supplied to the application surface from the liquid holding unit via the measuring roller rotating, and wherein after an end of application of the liquid to the medium, the liquid application method comprises the step of rotating the application roller in a state where rotation of the measuring roller is halted in such a manner that the liquid remaining on the application surface is recovered into the liquid holding unit.

According to the present invention, it is possible to increase the accuracy of the application volume, as well as being able to recover liquid that has not been transferred to the medium from the application roller, and prevent the liquid that has been transferred from precipitating on the surface of the application roller.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
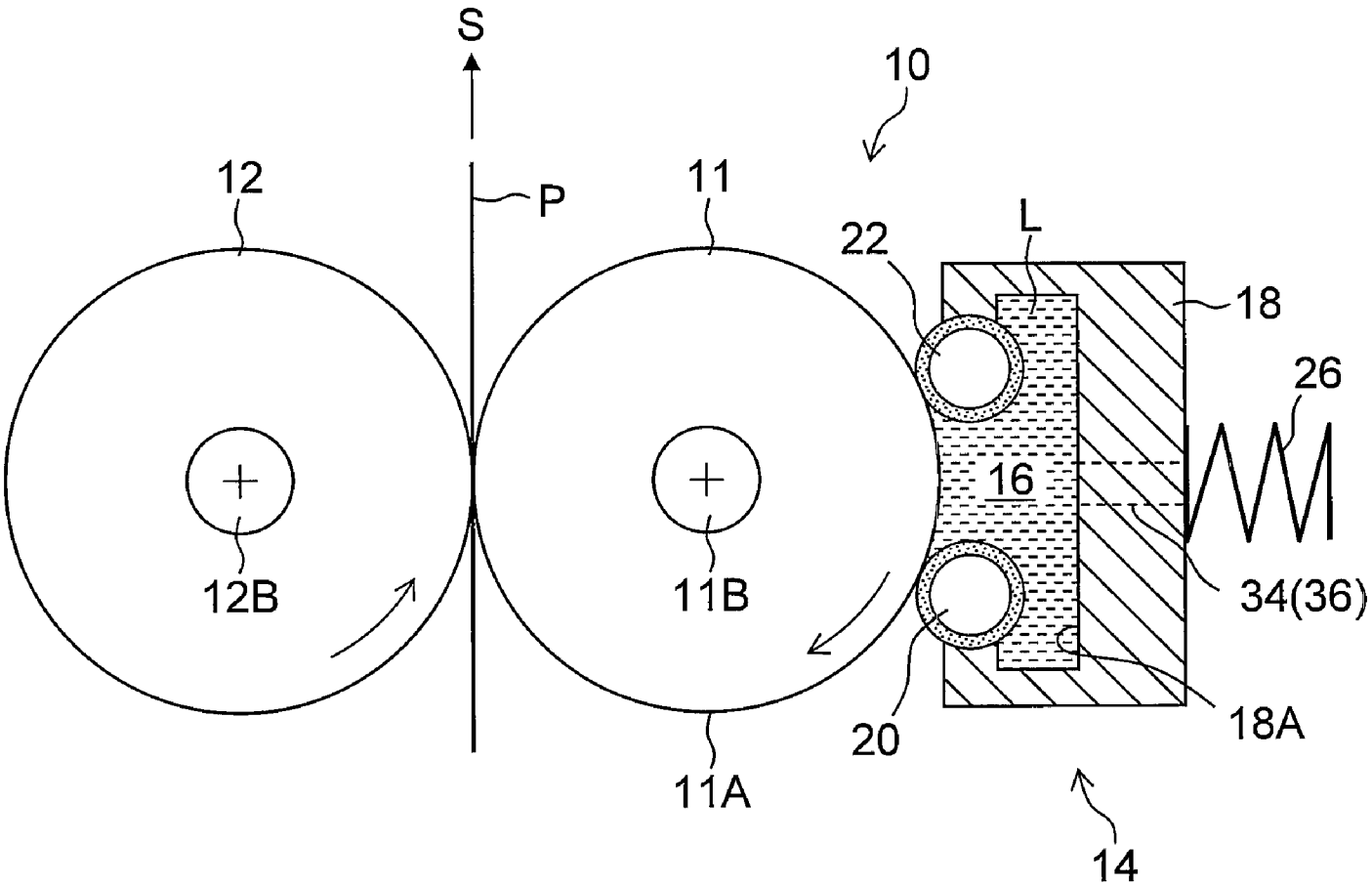
FIG. 1 is a cross-sectional diagram illustrating the principal composition of a liquid application apparatus relating to an embodiment of the present invention.

FIG. 1 is a cross-sectional diagram illustrating the principal composition of a liquid application apparatus relating to an embodiment of the present invention. As illustrated in FIG. 1, the liquid application apparatus 10 comprises: an application roller 11 which applies an application liquid while rotating in contact with a medium P which forms an application object, a counter roller 12 which is disposed opposing the application roller 11 via the conveyance path of the medium P, and a treatment liquid deposition unit 14 (equivalent to a "liquid holding unit") which supplies the treatment liquid L to the outer circumferential surface 11A (equivalent to an "application surface") of the application roller 11.

The application roller 11 and the counter roller 12 which sandwich the medium P therebetween respectively have rotating axles 11B and 12B following a linear axis direction which is perpendicular to the conveyance direction S of the medium P (the direction from bottom to top in FIG. 1) (namely, the axis direction in perpendicular to the plane of the drawing in FIG. 1 and is also referred to below as the "breadthways direction of the medium P").

The outer circumferential surface 11A of the application roller 11 is made of an elastic member, and the application roller 11 has a width in the breadthways direction of the medium P equal to or greater than the width dimension of the medium P. A rotational force is applied to the application roller 11 by a roller driving mechanism (not illustrated), and the roller is thereby driven in the clockwise direction in FIG. 1. The roller drive mechanism includes a roller drive motor which provides a source of motive force, and a drive transmission mechanism (such as toothed transmission mechanism or belt transmission mechanism, or the like) which transmits the drive force of the motor to the rotating axle 11B of the application roller 11.

The counter roller 12 has a width equal to or greater than the width of the application roller 11, and is impelled toward the outer circumferential surface 11A of the application roller 11 by an impelling device (not illustrated). The medium P which has been conveyed to the nip section between the application roller 11 and the counter roller 12 is conveyed in the conveyance direction S by the rotational force of the application roller 11 (rotation in the clockwise direction in FIG. 1).

The treatment liquid deposition unit 14 comprises a space forming base material 18 which has the shape of a recess section 18A that forms a space for a treatment liquid storage section 16, and rollers 20, 22 formed with cells (indentations) which abut against the outer circumferential surface of the application roller 11.

The first roller with cells 20 (which is equivalent to a "measurement roller") illustrated in the lower part of FIG. 1 is a roller which supplies a prescribed amount of treatment liquid to the outer circumferential surface 11A of the application roller 11, and also serves as a sealing member for the output portion where the application roller 11 emerges from the treatment liquid storage section 16 (in other words, the output portion of the treatment liquid onto the outer circumferential surface 11A of the application roller 11).

On the other hand, the second roller with cells 22 (which is equivalent to a "recovery roller") illustrated in the upper part of the FIG. 1 is a roller which recovers treatment liquid from the outer circumferential surface 11A of the application roller 11, and also serves as a seal member for the inlet portion where the application roller 11 returns to the treatment liquid storage section 16 (in other words, the return inlet portion of the treatment liquid which remains on the outer circumferential surface 11A of the application roller 11).

Figure 2B:
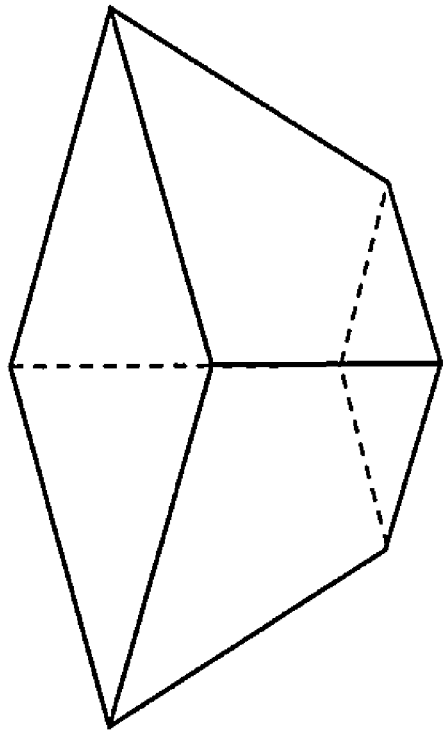
FIGS. 2A and 2B are enlarged schematic drawings illustrating examples of the shape of the cells of the rollers with cells.
Figure 2A:
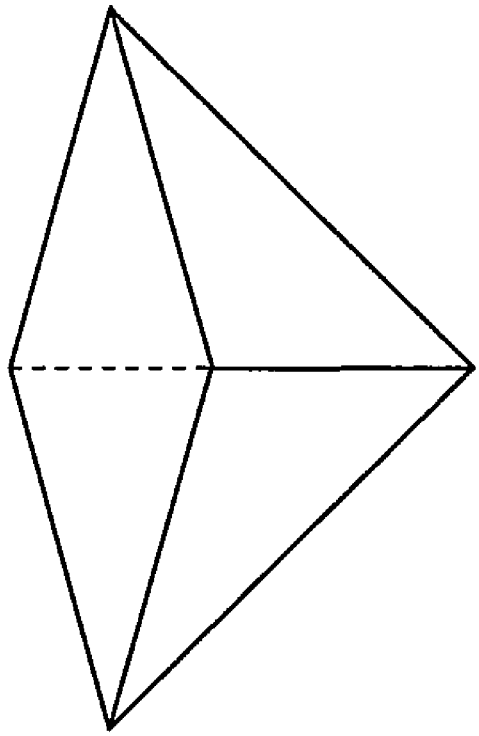

The rollers with cells 20, 22 are rollers in which a plurality of precise liquid holding cells which are engraved in a pyramid shape (see FIG. 2A) or lattice shape (truncated cone shape) (see FIG. 2B) are formed at a prescribed density in the outer circumferential surface of the roller; a roller of this kind is generally called an anilox roller, a precision roller, a gravure roller, or the like.

There are no particular restrictions of the shape or mode of arrangement of the cells on the surface of the roller, but a desirable mode is one in which the cells are aligned in an oblique direction which is not perpendicular to the direction of rotation. For example, the cells of the rollers with cells 20, 22 in the present embodiment which is illustrated in FIG. 1 are geometric cells of a pyramid shape formed in 150 lines (per inch) which are engraved completely by a mechanical device. If fine cells are engraved by irradiating laser light in a ceramic layer, then the cross-sectional shape of the cell is semicircular, but the resulting cell surface varies depending on the angle of the cells in the engraving pattern, to form a honeycomb pattern, a diamond pattern, a helical pattern, or the like, due to interference between the molten material of neighboring cells (see Rolltech Co. Ltd. homepage (http://www.rolltech.jp/furekiso.htm) (searched 24 Jan. 2008).

The shape, depth, volume and density of the cells are selected appropriately in accordance with the amount of liquid that is to be applied to the medium P (the thickness of the liquid film after application).

The two rollers with cells 20 and 22 are disposed at a prescribed interval apart in the direction of rotation (tangent) of the application roller 11, and are supported rotatably on the space forming base material 18. The rollers with cells 20 and 22 do not need to be provided with drive devices in order to drive the rollers respectively and independently, but an electrically controllable brake mechanism (not illustrated in FIG. 1 and indicated by reference numeral 74 in FIG. 6) is provided on the roller with cells 20 on the output side (supply side). Although the details are described later on, when applying treatment liquid to the medium P, in other words, when supplying treatment liquid to the outer circumferential surface 11A of the application roller 11, the brake of the roller with cells 20 is released and the roller rotates following the rotation of the application roller 11. On the other hand, when application has been completed, the rotation of the roller with cells 20 on the supply side is halted and the supply of new treatment liquid to the surface of the application roller 11 is halted.

An impelling member 26, such as a spring member, is provided on the rear side of the space forming base material 18 on which the rollers with cells 20 and 22 described above are provided, and the treatment liquid deposition unit 14 is impelled toward the outer circumferential surface 11A of the application roller 11 by the impelling force of the impelling member 26. The surface of the application roller 11 is constituted by an elastic member, and therefore when the treatment liquid deposition unit 14 is pressed against the roller 11, the portions of the application roller 11 which make contact with the rollers with cells 20 or 22 are deformed (see FIG. 3).

Accordingly, the two rollers with cells 20 and 22 are pressed and abutted (in a state of tight contact) against the outer circumferential surface 11A of the application roller 11. In an abutted state of this kind, a sealed treatment liquid storage section 16 (also called a "liquid holding space") is formed by the outer circumferential surface 11A of the application roller 11, the rollers with cells 20, 22, and the recess section 18A of the space forming base material 18. Treatment liquid L is filled into this sealed liquid holding space (treatment liquid storage section 16).

Figure 3:
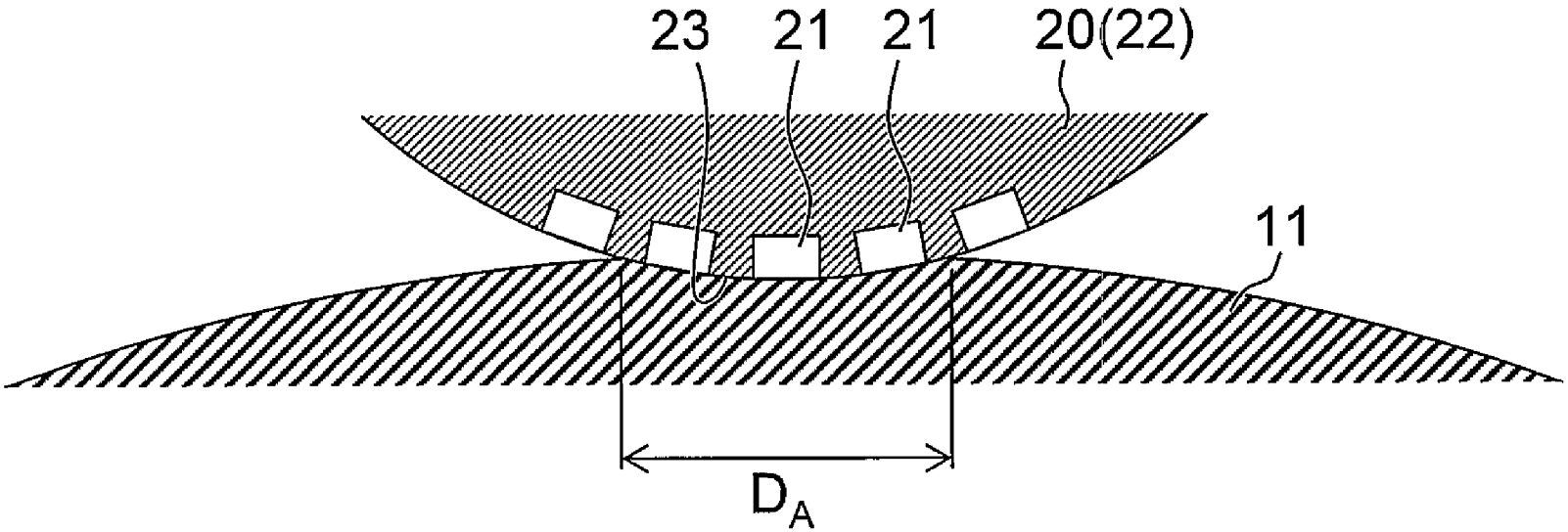
FIG. 3 is an enlarged diagram of the contacting portion between a roller with cells and an application roller.

FIG. 3 is an enlarged diagram of the region of contact between a roller with cells 20 (or 22) and the application roller 11, and depicts a schematic cross-sectional view perpendicular to the axis of the roller. As illustrated in FIG. 3, the application roller 11 is pressed and squeezed in a prescribed width region ($D_A$) corresponding to a distance which spans a plurality of cells 21 in the direction of rotation of the surface of the roller with cells 20 (or 22) (the direction of the tangent to the point of contact with the application roller 11). Due to this deformation of the application roller 11, the wall portions 23 between the respective cells 21 of the roller with cells 20 (or 22) make contact with the surface of the application roller 11, thereby providing a sealing function. Consequently, when the application roller 11 and the rollers with cells 20, 22 are at rest, the treatment liquid is prevented from leaking out to the exterior.

Figure 4:
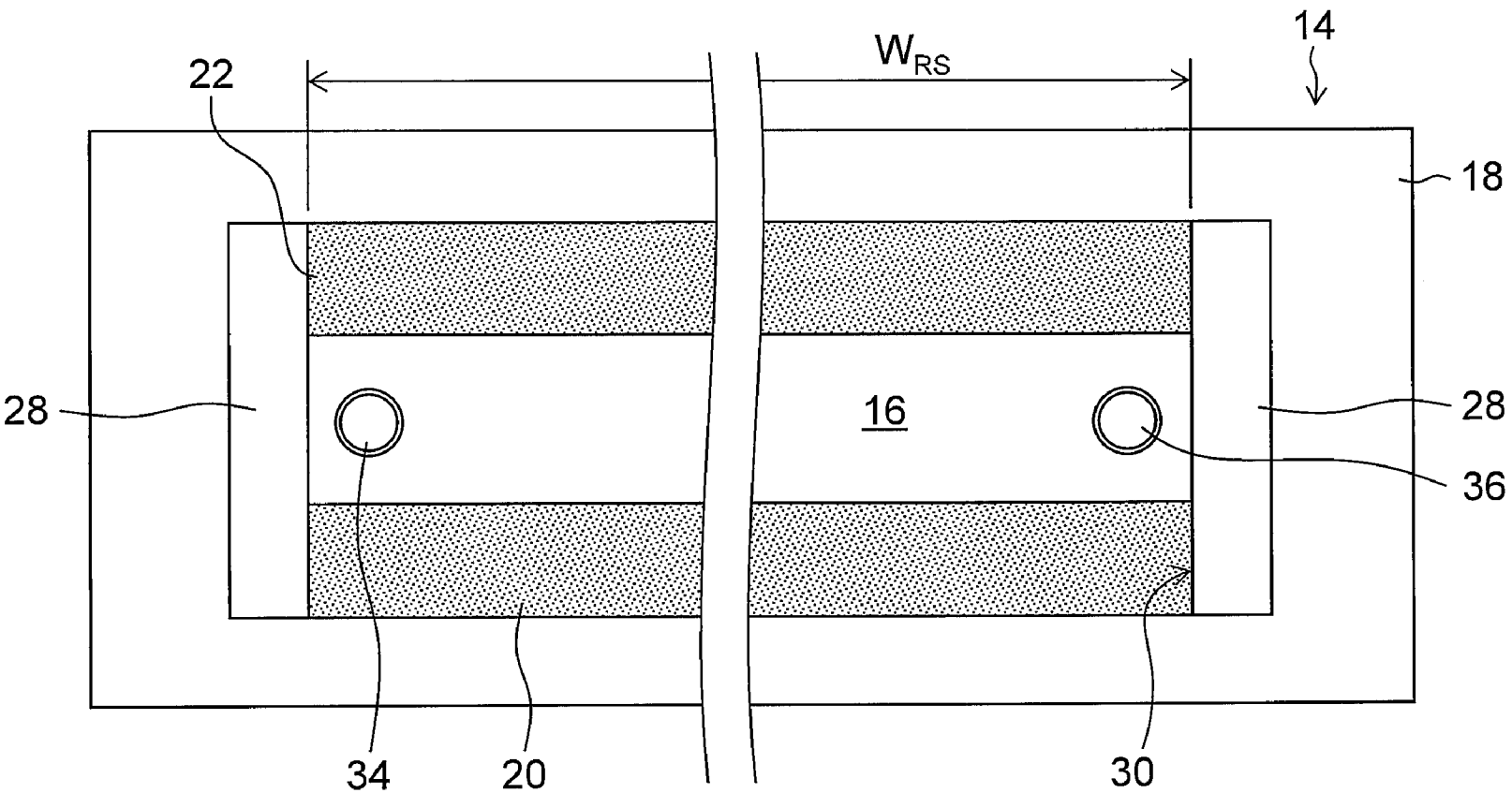
FIG. 4 is a plan diagram of a treatment liquid deposition unit.

FIG. 4 is a plan diagram of the treatment liquid deposition unit 14 viewed from the side of the rollers with cells 20 and 22. The rollers with cells 20, 22 have a width $W_{RS}$ which is the same as the liquid application width of the application roller 11 (see FIG. 1), and sealing members 28, 28 that constitute the side walls of the treatment liquid storage section 16 are provided at either end of these rollers. On the contacting surfaces 30 between the sealing members 28, 28 which are fixed to the space forming base material 18 and the rollers with cells 20, 22, elastic sliding members (not illustrated) are provided and these elastic sliding members have a sealing function, thereby allowing the rollers with cells 20 and 22 to rotate without any leakage of liquid.

Figure 5:
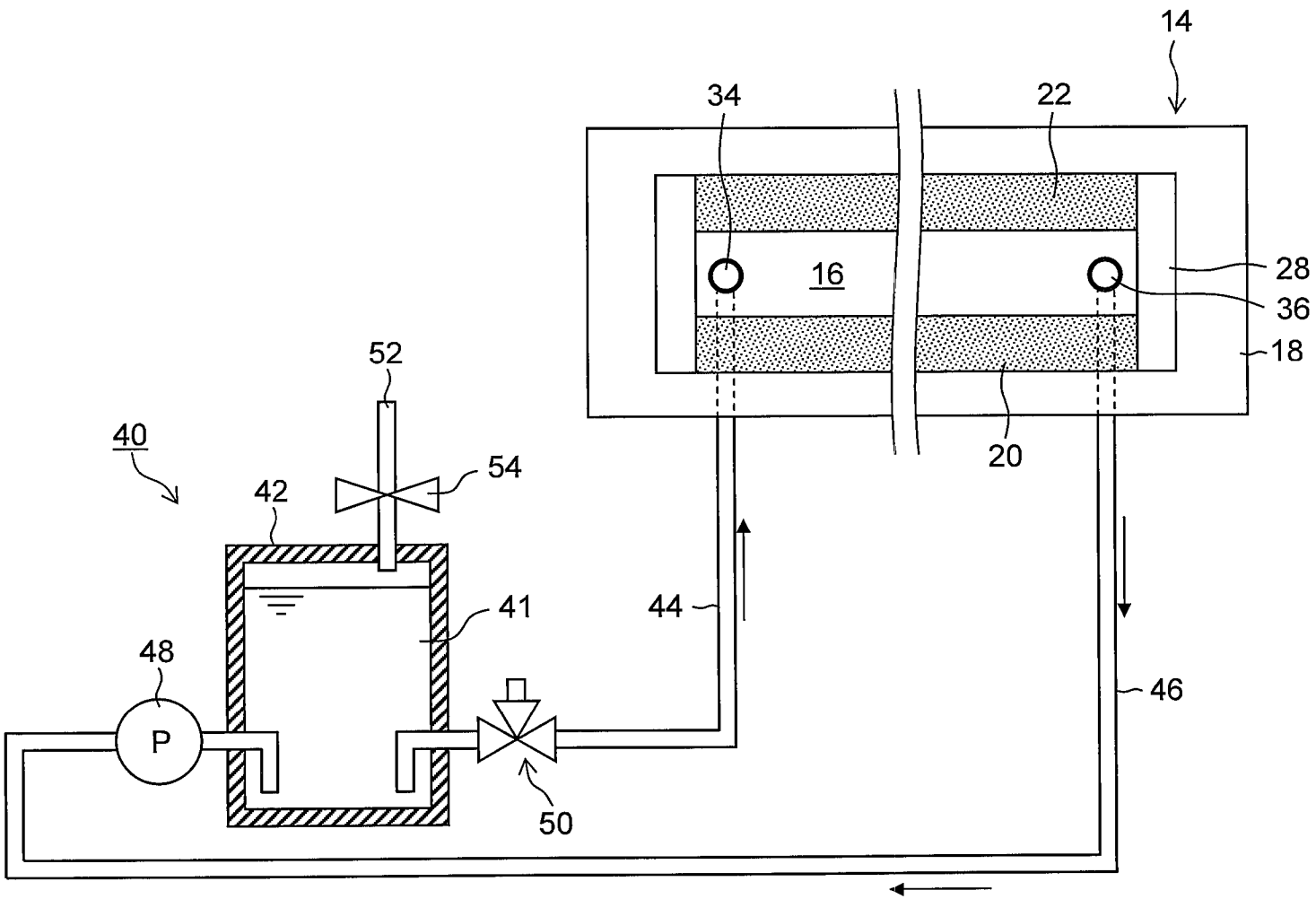
FIG. 5 is a general schematic drawing of a treatment liquid supply apparatus which is connected to a treatment liquid deposition unit.

A liquid supply port 34 and a liquid discharge port 36 are formed in the rear surface side of the space forming base material 18 by through holes which connect with the space of the treatment liquid storage section 16. As illustrated in FIG. 5, a supply flow channel 44 and a recovery flow channel 46 for the treatment liquid are connected respectively to the liquid supply port 34 and the liquid discharge port 36, and treatment liquid can be supplied to the treatment liquid storage section 16 and treatment liquid can be expelled forcibly from the treatment liquid storage section 16, by driving a pump 48.

FIG. 5 is a general schematic drawing of a treatment liquid supply apparatus 40 which is connected to the treatment liquid deposition unit 14. The treatment liquid supply apparatus 40 comprises: a storage tank 42 which stores treatment liquid 41; a supply flow channel 44 which leads treatment liquid from the storage tank 42 to the liquid supply port 34 of the treatment liquid deposition unit 14; a recovery flow channel 46 which returns treatment liquid from the liquid discharge port 36 of the treatment liquid deposition unit 14 to the storage tank 42; a pump 48; and a switching valve (in this case, a three-way valve) 50 which is provided at a certain point of the supply flow channel 44.

One end of the supply flow channel 44 is connected to the liquid supply port 34 of the treatment liquid deposition unit 14, and the other end is connected to the liquid layer in the storage tank 42. This supply flow channel 44 can be switched so as to open or close the flow channel, and connect to or shut off from the air, by means of the switching valve 50.

One end of the recovery flow channel 46 is connected to the liquid discharge port 36 of the treatment liquid deposition unit 14, and the other end is connected to the liquid layer in the storage tank 42. The pump 48 is provided at a certain point of the recovery flow channel 46 (desirably, in the vicinity of the storage tank 42), and generates a flow whereby liquid or air is forcibly caused to flow in the direction of the arrow in FIG. 5.

An air connection port 52 is provided in the storage tank 42, and an air connection valve 54 which switches between connecting to and shutting off the air is provided in the air connection port 52.

Description of Control System

Figure 6:
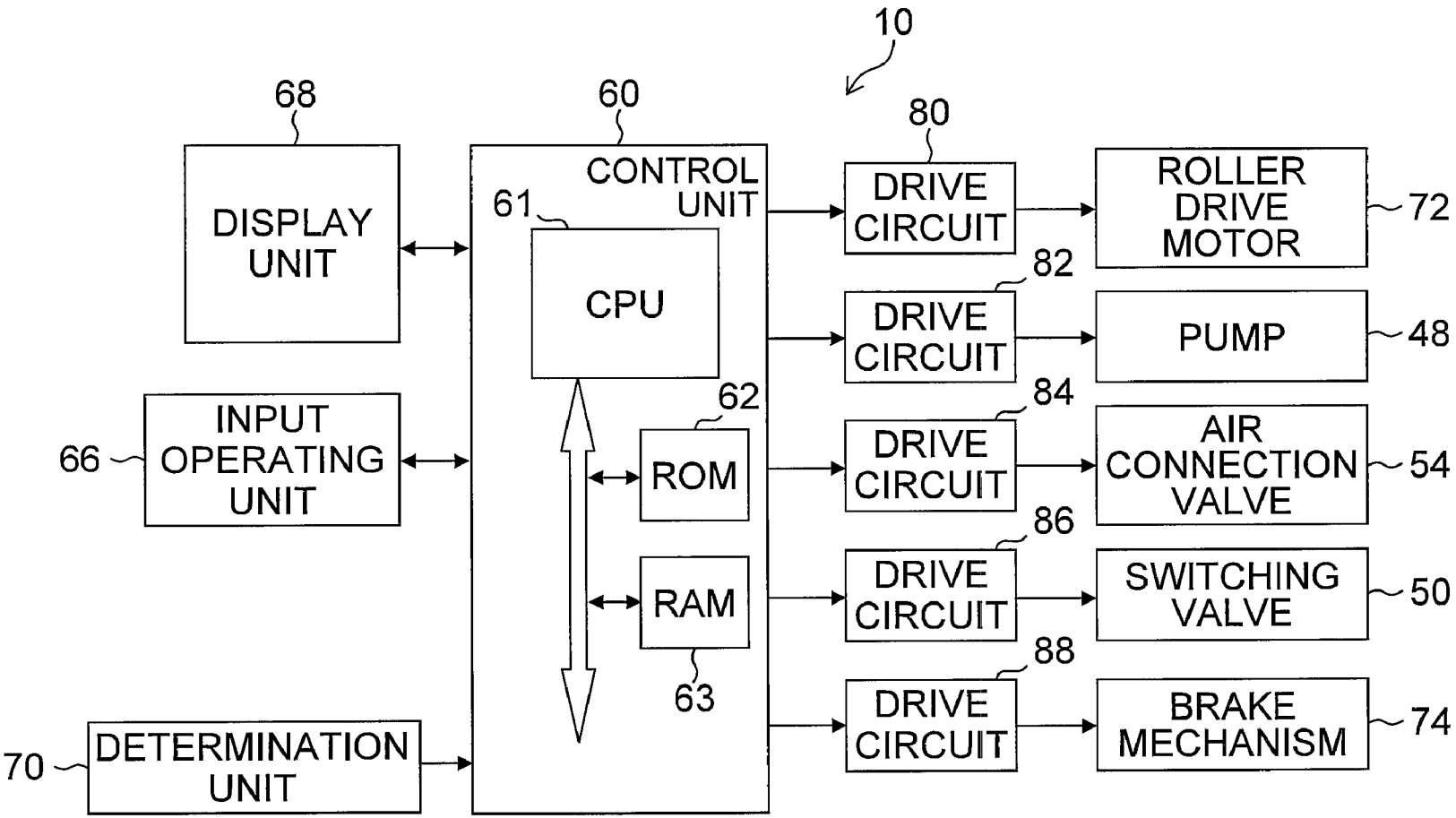
FIG. 6 is a block diagram illustrating the composition of the control system of a liquid application apparatus according to an embodiment of the present invention.

FIG. 6 is a block diagram illustrating the composition of the control system of a liquid application apparatus 10 according to the present embodiment.

In FIG. 6, the control section 60 (which is equivalent to a "drive control device") is a control device which performs overall control of the whole of the liquid application apparatus 10. The control unit 60 comprises: a CPU (Central Processing Unit) 61 which executes processing of various types in accordance with prescribed programs; a ROM (Read Only Memory) 62 which stores programs, data of various types, and the like; and a RAM (Random Access Memory) 63 which temporarily stores data, and the like, that are used in the various types of processing.

The input operating unit 66 is constituted, for example, by a keyboard or mouse (or various switches, or the like) which is used to input prescribed instructions or data. The display unit 68 constitutes a user interface together with the input operating unit 66 and provides various displays in conjunction with the control unit 60. For example, the display unit 68 is constituted by a liquid display apparatus.

Furthermore, the liquid application apparatus 10 comprises a determination unit 70 which includes a sensor (medium size determination sensor) for determining the width size of the medium P (see FIG. 1) (the size in the breadthways direction which is perpendicular to the conveyance direction S), a sensor (medium position determination sensor) for determining the position of the medium P, and in addition to these, a sensor which determines the operational states of the respective units, and the like. The signals from the determination unit 70 are sent to the control unit 60, and are used to drive the roller and control other operations.

Furthermore, the liquid application apparatus 10 comprises a roller drive motor 72 which drives the application roller 11 (see FIG. 1), the pump 48 (see FIG. 5), the air connection valve 54, the switching valve 50, a brake mechanism 74 and drive circuits 80, 82, 84, 86 and 88 corresponding to these respective elements; and the control unit 60 sends control signals to the respective drive circuits 80 to 88 in accordance with programs, and thereby controls the operation of the respective elements.

Next, the operation of the liquid application apparatus 10 having the composition described above will be explained.

Figure 7:
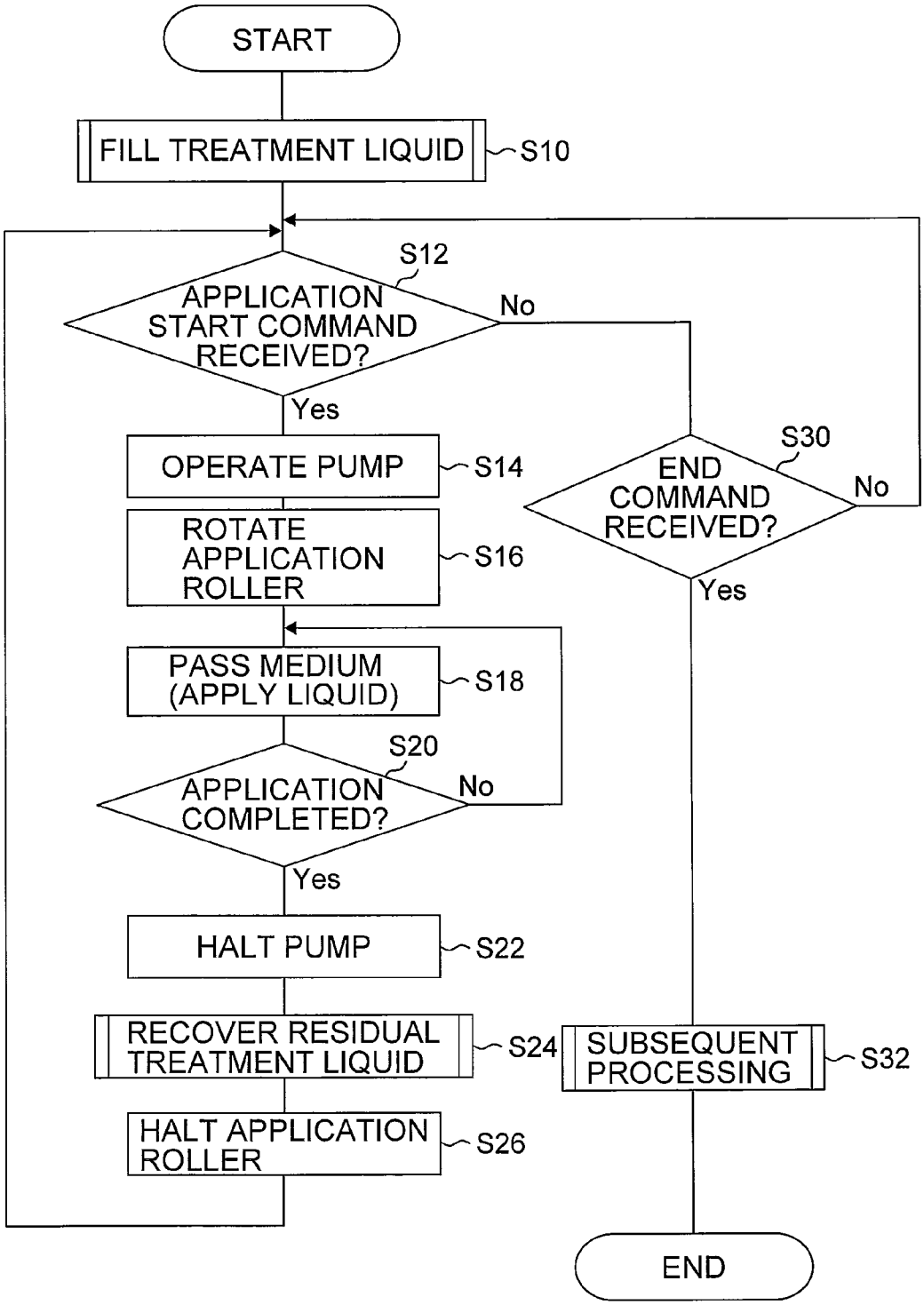
FIG. 7 is a flowchart illustrating the operational sequence of a liquid application apparatus.

FIG. 7 is a flowchart illustrating the operational sequence of the liquid application apparatus 10. These operations are executed in accordance with a program(s), under the control of the control unit 60 illustrated in FIG. 7.

Firstly, in an initial state when this sequence is started, treatment liquid has not been introduced into the treatment liquid storage section 16, which is in an empty state, and at step S10, a step of filling treatment liquid into the treatment liquid storage section 16 of the treatment liquid deposition unit 14 is carried out. In this filling step, the switching valve 50 of the supply flow channel 44 is set to the supply flow channel side (a state which opens the supply flow channel 44), and furthermore the air connection valve 54 of the storage tank 42 is opened and the pump 48 is driven for a certain period of time in a state where the storage tank 42 is connected to the air.

Accordingly, the air inside the space is sent to the storage tank 42 and is expelled into the outside air from the storage tank 42, while at the same time treatment liquid is filled into the respective units of the supply flow channel 44, the treatment liquid storage unit 16 and the recovery flow channel 46. In this way, a state is achieved in which treatment liquid can be supplied to the application roller 11 which lies in contact with the treatment liquid storage section 16. The driving time period of the pump 48 is set by anticipating the time taken to complete the initial filling operation. After driving for a prescribed time period, the pump 48 is halted.

Thereupon, the presence or absence of an application start command is judged (step S12). An application start command signal is issued in coordination with the conveyance of the medium P. The application start command signal is issued at a prescribed time differential in such a manner that the application of treatment liquid starts at the time when the medium P arrives at the nip section between the application roller 11 and the counter roller 12.

When the application start command is input and a YES verdict is obtained at step S12, then the pump 48 is operated (step S14), and furthermore the roller driving is started to rotate the application roller 11 in the clockwise direction in FIG. 1 (step S16). The rollers with cells 20 and 22 are caused to rotate following the rotation of the application roller 11.

The cell shape of the roller with cells 20 is set in accordance with the treatment liquid volume that is to be applied to the medium P, and treatment liquid of a uniform volume which is stable at all times is measured out in accordance with the volume of the cells and the treatment liquid inside the space forming base material 18 is thereby supplied onto the surface of the application roller 11.

In this way, the treatment liquid adheres to the outer circumferential surface 11A of the application roller 11 in the form of a layer. The treatment liquid adhering to the circumferential surface of the application roller 11 rotates with the application roller 11, and is conveyed to an abutting section with the counter roller 12.

Furthermore, by means of the medium P being conveyed by the medium conveyance mechanism, the medium P is supplied between the application roller 11 and the counter roller 12. The medium P nipped between the two rollers 11 and 12 is conveyed by the rotational force of the application roller 11, and furthermore, when it is conveyed between the rollers, the treatment liquid on the outer circumferential surface of the application roller 11 is transferred to the medium P (step S18).

Figure 8:
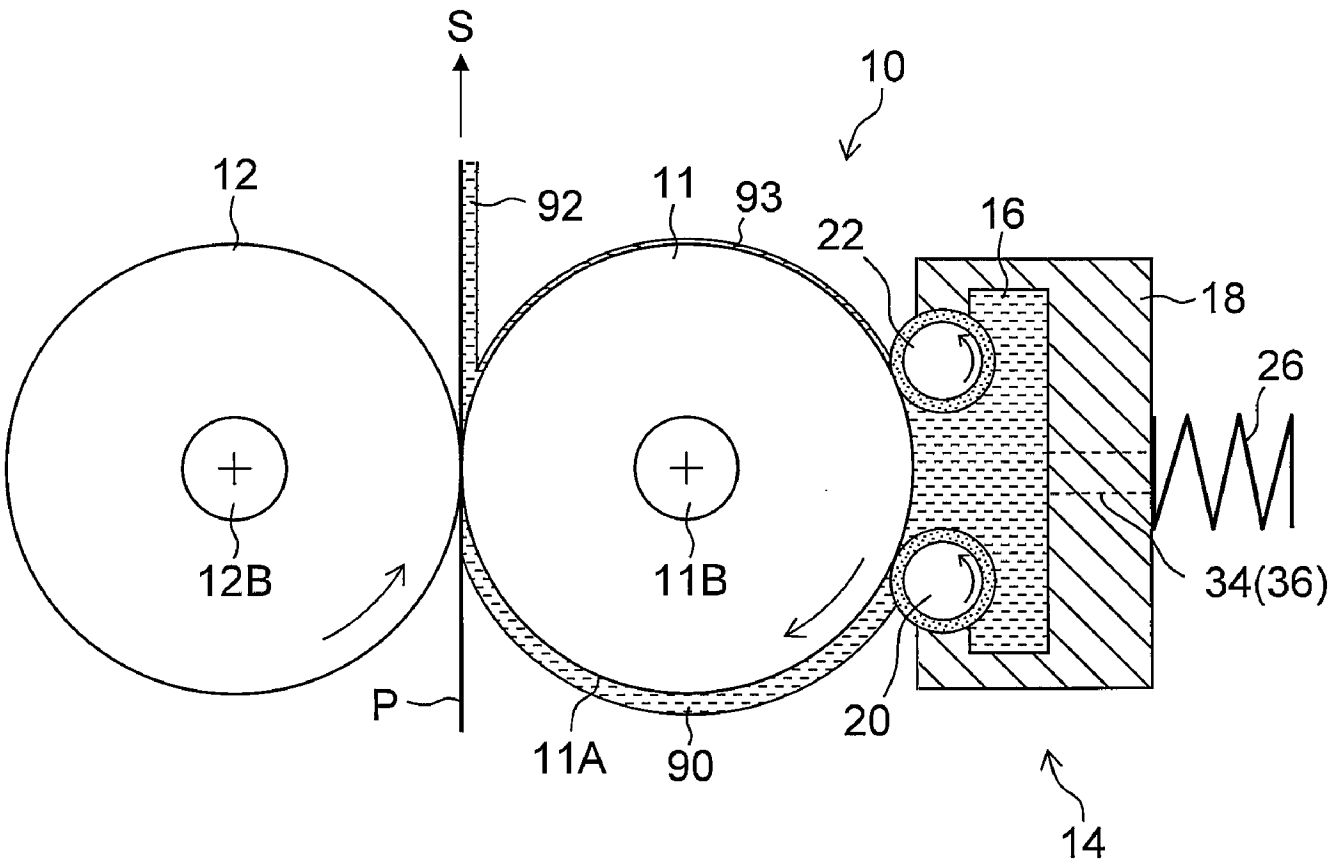
FIG. 8 is an illustrative diagram illustrating an aspect of a liquid application step.

FIG. 8 illustrates an aspect of the application step in step S18. The thickness of the treatment liquid layer in FIG. 8 is depicted in an exaggerated fashion to be much larger than its actual size ratio. As illustrated in FIG. 8, the treatment liquid 90 which has been supplied to the outer circumferential surface 11A of the application roller 11 via the roller with cells 20 makes contact with one surface of the medium P due to the rotation of the application roller 11 and is thereby applied to the medium P. The medium P which is sandwiched between the application roller 11 and the counter roller 12 is conveyed in the conveyance direction S by the rotational force of the application roller 11. In this way, a prescribed amount of treatment liquid 92 is deposited onto the medium P which has passed between and the application roller 11 and the counter roller 12.

Desirably, in order to improve the transfer characteristics of the treatment liquid from the application roller 11 onto the medium P, the surface free energy of the application roller 11 is smaller than the surface free energy of the medium P. In other words, a material which satisfies the inequality relationship indicated in Expression 1 below is used for the surface member of the application roller 11.

$$\text{Surface free energy of application roller 11} < \text{Surface free energy of medium P} \qquad \text{Expression 1}$$

Ideally, all of the treatment liquid 90 supplied onto the outer circumferential surface 11A of the application roller 11 by the roller with cells 20 is transferred onto the medium P, but in actual practice, treatment liquid that has not been transferred from the surface of the application roller 11 after contact with the medium P remains on the application roller 11.

This residual treatment liquid 93 which has not been transferred is recovered into the treatment liquid storage section 16 of the treatment liquid deposition unit 14 via the roller with cells 22.

When the application operation onto the medium P described above has been carried out, the control unit 60 judges the end timing of the application operation (step S20 in FIG. 7). If liquid is applied to the whole surface of the medium P, then the judgment at step S20 produces a NO verdict and returns to step S18, until the medium P has passed completely.

If it is judged that the application step in the required application range has been completed (YES verdict at step S20), for instance, the timing of the passage of the trailing edge of the medium P is detected or the end of a job of a specified number of sheets is detected, then the pump 48 is halted (step S22), and residual treatment liquid recovery processing is carried out (step S24).

The residual treatment liquid recovery processing involves an operation of recovering the treatment liquid remaining on the circumferential surface of the application roller 11 into the treatment liquid deposition unit 14. In other words, a brake is applied to the output side roller with cells 20 to halt the rotation of this roller with cells 20 only, and the application roller 11 is rotated to cause the return side roller with cells 22 to rotate therewith, whereby the residual treatment liquid is recovered.

In order to recover all of the residual treatment liquid on the surface of the application roller 11, it is necessary at the least to rotate the application roller 11 until the position on the application roller 11 which lies in contact with the roller with cells 20 when the brake is applied to the output side roller with cells 20 reaches the position of the return side roller with cells 22. In practical terms, it is sufficient for the application roller 11 to perform one revolution in a state where the roller with cells 20 has been halted. Consequently, it is possible to prevent precipitation (separation) of the treatment liquid which is remaining on the circumferential surface of the application roller 11.

The surface of the counter roller 12 has high lyophobic properties, such as a fluorine coating, and is composed in such a manner that treatment liquid does not become attached readily to the surface of the counter roller 12 due to contact between the application roller 11 and the counter roller 12. By suitably designing the relationship between the free surface energy of the surface members of the respective rollers, it is possible to prevent treatment liquid from becoming attached to the counter roller 12. Desirably, a movement mechanism which is able to change the distance between the application roller 11 and the counter roller 12 is provided on at least one of these rollers, and the adherence of treatment liquid to the surface of the counter roller 12 is prevented by carrying out the residual treatment liquid recovery processing (step S24) when these two rollers are in a mutually distanced state.

When the residual treatment liquid recovery processing (step S24) has been completed, the application roller 11 is halted (step S26) and the procedure returns to step S12.

At step S12, if a new application start command is input, then the processing in step S14 to step S26 described above is repeated. On the other hand, if at step S12 the application start command has not been input, then the procedure advances to step S30, and it is judged whether or not there is an application end command (step S30). The end command may use one of various modes, such as a mode where an end command is issued automatically when a specified wait time has elapsed on the basis of time management using a timer, or the like, a mode where an end command is issued when application onto a specified number of sheets of media has been completed, a mode based on an operation from the input operating unit 66, or a mode based on a switching off operation of the apparatus power supply, or the like.

If an end command has not been input, then the procedure returns to step S12. At step S30, if an end command has been input, then the procedure advances to the subsequent processing step in step S32. The subsequent processing step (step S32) involves an operation for recovering into the storage tank 42 the treatment liquid inside the treatment liquid storage section 16 of the treatment liquid deposition unit 14, and the supply flow channel 44 and recovery flow channel 46 which are connected to same.

This recovery operation is carried out by opening the switching valve 50 to the air, and closing the air connection valve 54 of the storage tank 42 and driving the pump 48 for a prescribed period of time. A sufficient pump driving time is established in order that all of the treatment liquid remaining inside the respective sections is caused to flow into the storage tank 42.

After the recovery operation, the air connection valve 54 is closed, the switching valve 50 is also closed, and furthermore, the supply flow channel 44 is shut off and the connection to the outside air is shut off. In this way, the storage tank 42 is closed off from the outside air, thereby preventing evaporation or leakage to the exterior.

Example of Application to Image Forming Apparatus

Figure 9:
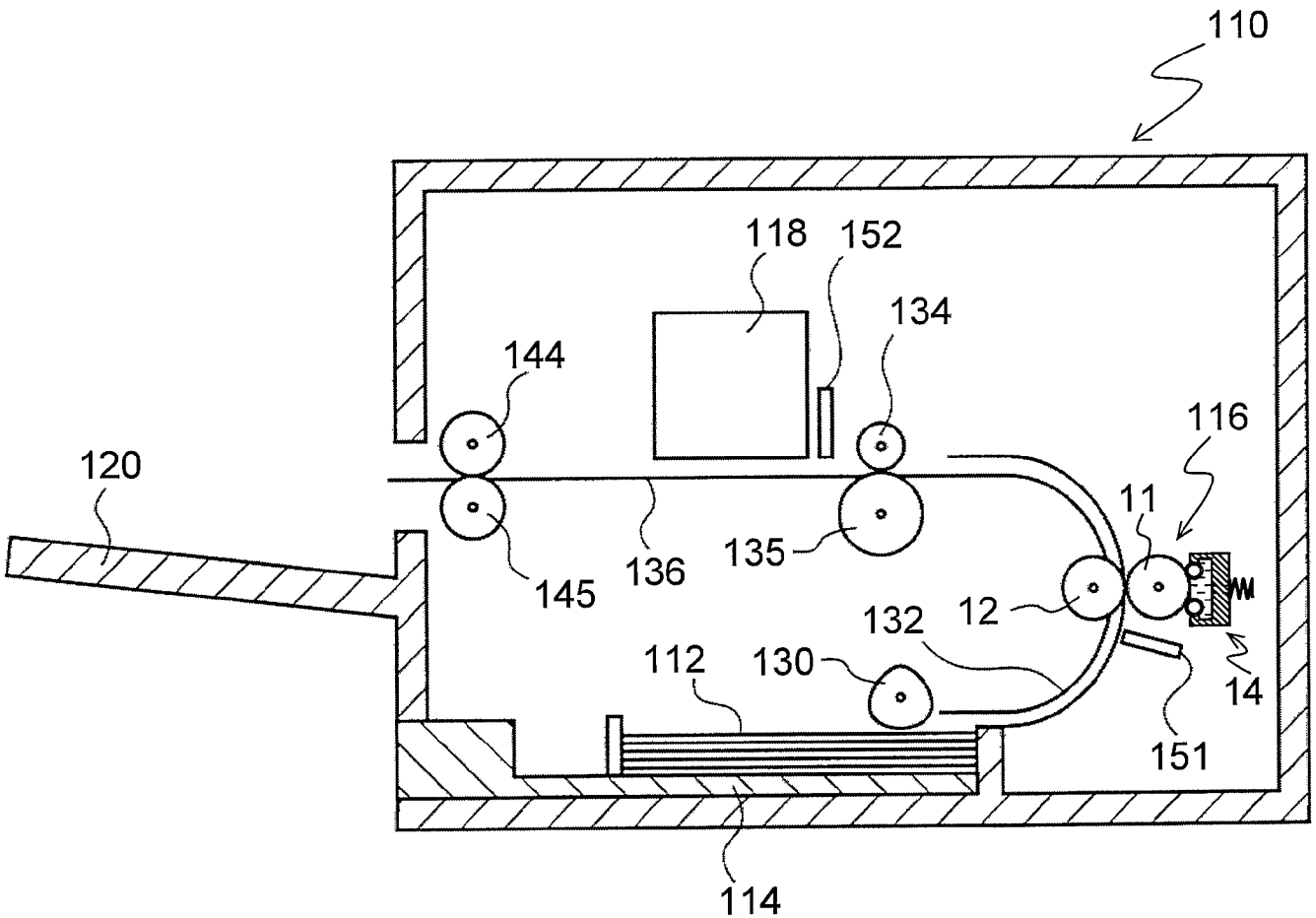
FIG. 9 is a schematic drawing of an inkjet recording apparatus relating to an embodiment of the present invention.

FIG. 9 is a schematic drawing of an inkjet recording apparatus relating to one example of an image forming apparatus which comprises a liquid application apparatus according to an embodiment of the present invention.

The inkjet recording apparatus 110 comprises: a paper supply unit 114 which supplies a recording medium 112 (equivalent to the "medium P" illustrated in FIG. 1); a treatment liquid application unit 116 which applies treatment liquid to the recording medium 112 supplied from the paper supply unit 114; an ink droplet ejection unit 118 which ejects droplets of ink onto the recording medium 112 after the application of treatment liquid; and a paper output tray 120 where the recording medium 112 on which an image has been formed by the ink droplet ejection unit 118 is output.

The paper supply unit 114 employs a method based on a paper supply cassette in which a plurality of sheets of recording media 112 cut to a prescribed size are loaded. It is also possible to provide a plurality of paper supply cassettes in such a manner that papers of a plurality of different sizes can be supplied. Furthermore, it is also possible to adopt a mode in which rolled paper (continuous paper) is used instead of cut sheet, and the rolled paper is cut to an appropriate size by a cutter.

The recording medium 112 which is loaded in the paper supply unit 114 is supplied to the conveyance path 132 repeatedly, one sheet at a time, by the paper supply roller 130. The treatment liquid application unit 116 which is provided in the conveyance path 132 employs the composition of the liquid application apparatus 10 illustrated in FIG. 1 to FIG. 8. In FIG. 9, elements which are the same as or similar to the liquid application apparatus 10 described with reference to FIG. 1 to FIG. 8 are labeled with the same reference numerals and description thereof is omitted here. In FIG. 9, for the sake of convenience, only a portion of the treatment liquid deposition unit 14 in the liquid application apparatus 10 is depicted.

The recording medium 112 onto which treatment liquid has been applied by the application roller 11 of the treatment liquid application unit 116 is conveyed over the platen 136 by the conveyance roller pairs 134 and 135.

The ink droplet ejection unit 118 is provided on the downstream side of the treatment liquid deposition unit 14 in terms of the direction of conveyance of the medium. The ink droplet ejection unit 118 according to the present example is constituted by recording heads of an inkjet type which correspond respectively to inks of four colors of yellow (Y), magenta (M), cyan (C) and black (K). Although not illustrated in the drawings, inks of the corresponding colors are supplied respectively to the recording heads of the respective colors, from ink tanks which are not illustrated.

The recording heads of the respective colors in the ink droplet ejection unit 118 are each heads of a full line type which respectively have a length corresponding to the maximum width of the image forming region on the recording medium 112 and comprise a plurality of ink ejection nozzles arranged through the full width of the image forming region on the ink ejection surface of the head.

The recording heads of the respective colors are fixed so as to extend in a direction perpendicular to the direction of conveyance of the recording medium 112 (the direction perpendicular to the plane of the drawing in FIG. 9), and respectively eject liquid droplets of the corresponding colored ink onto the recording medium 112 on the platen 136.

In this way, according to a composition in which full line heads having nozzle rows covering the full width of the image forming region of the recording medium 112 are provided for each color of ink, it is possible to record an image on the image forming region of the recording medium 112 by performing just one operation of moving the recording medium 112 and the recording head relatively with respect to each other in the direction of conveyance of the recording medium 112 (the sub-scanning direction), in other words, by performing just one sub-scanning.

It is also possible to adopt a mode which employs, instead of full line heads, heads of a serial (shuttle) type which move reciprocally back and forth in a direction (main scanning direction) perpendicular to the direction of conveyance of the recording medium 112 (sub-scanning direction), but forming an image by a single pass method using heads of a full line type (page-wide heads) enables faster printing than a multi-pass method using serial (shuttle) type heads, and therefore the print productivity can be improved.

Although the configuration with the CMYK four colors is described in the present embodiment, combinations of the ink colors and the number of colors are not limited to those. Light inks, dark inks or special color inks can be added as required. For example, a configuration is possible in which recording heads for ejecting light-colored inks such as light cyan and light magenta are added. Furthermore, there are no particular restrictions of the sequence in which the heads of respective colors are arranged.

Possible examples of the ink used in the inkjet recording apparatus 110 according to the present embodiment include a dye-based ink in which a coloring material is dissolved in a molecular state (an ionic state is also possible) in the solvent of the liquid, and a pigment-based ink in which a coloring material is dispersed in the solvent of the liquid in a state of small particles.

On the other hand, the treatment liquid is a liquid which generates an aggregate of the coloring material when mixed with an ink. Specific examples of the treatment liquid include a treatment liquid which precipitates or insolubilizes the coloring material in the ink by reacting with the ink, and a treatment liquid which generates a semi-solid material (gel) that includes the coloring material in the ink, and the like.

The means of generating a reaction between the ink and the treatment liquid may be a method which causes an anionic coloring material in the ink with a cationic compound in the treatment liquid, a method which aggregates pigment by breaking down the dispersion of the pigment in the ink due to altering the pH of the ink by mixing an ink and a treatment liquid which have different pH values, a method which aggregates pigment by breaking down the dispersion of the pigment in the ink due to a reaction with a polyvalent metal salt in the treatment liquid, or the like.

For instance, examples of a treatment liquid having an action of aggregating the coloring material contained in ink which is ejected as droplets from the ink droplet ejection unit 118 according to the present embodiment are aggregating treatment agents, such as a polyvalent metal salt, polyallylamine, a polyallylamine derivative, an acidic liquid, a cationic surfactant, and the like. By promoting the aggregation of the coloring material on the recording medium 112 by means of a treatment liquid of this kind, it is possible to improve the recording density as well as reducing or preventing bleeding.

The recording medium 112 on which an image has been formed by ejection of ink droplets from the ink droplet ejection unit 118 (the medium which has completed recording) is output to the output tray 120 by a pair of output rollers 144 and 145.

Medium leading edge determination sensors 151 and 152 which determine the leading edge of the recording medium 112 are disposed in the conveyance path 132 of the recording medium 112. The first medium leading edge determination sensor 151 is disposed in the vicinity of the input to the application roller 11 on the paper supply side. The second medium leading edge determination sensor 152 is disposed in the vicinity of the input to the ink droplet ejection unit 118 on the paper supply side.

The treatment liquid application timing and the ink droplet ejection timing are controlled by determining the position of the recording medium 112 by means of these sensors (151, 152).

Control of Rotation of Roller with Cells

Table 1 illustrates the operational states of the application roller 11 and the rollers with cells 20 and 22 in the respective operating modes of the inkjet recording apparatus 110.

TABLE 1

| Operating mode | Application roller | Roller with cells (supply side) | Roller with cells (recovery side) |
|---|---|---|---|
| Printing in progress | Rotating | Rotating | Rotating |
| Maintenance immediately after end of printing | Rotating | Halted | Rotating |
| Printing operation idle | Halted | Halted | Halted |

1. Printing in Progress Mode

When printing is in progress, the brake on the roller with cells 20 is released and the application roller 11 is caused to rotate. In this case, as described with reference to FIG. 8, the supply side roller with cells 20 rotates together with the application roller 11, and a prescribed amount of treatment liquid is measured and supplied to the circumferential surface of the application roller 11. Moreover, since the recovery side (return side) roller with cells 22 rotates following the rotation of the application roller 11, then even if there is treatment liquid remaining on the application roller 11 which has not been transferred to the recording medium 112, this residual treatment liquid is returned to the treatment liquid storage section 16. Therefore, it is possible to eliminate the problem of the collection of liquid between the abutting member and the roller which is an issue in the structure described in Japanese Patent Application Publication No. 2007-83180.

2. Maintenance Mode Immediately After End of Printing

At a time immediately after the end of the application of treatment liquid to the recording medium 112, treatment liquid adheres to the surface of the application roller 11. In particular, treatment liquid in an unapplied state remains on the surface of the application roller 11 in the section from the abutting position against the roller with cells 20 until the abutting position against the counter roller 12. Therefore, in the present embodiment, when the application has been completed, a brake is applied to the roller with cells 20, and with the roller with cells 20 in a halted state, the application roller 11 is rotated to cause the return side roller with cells 22 to rotate therewith. In other words, only the supply side roller with cells 20 is halted.

In so doing, the supply of new treatment liquid from the roller with cells 20 is halted, while at the same time the residual treatment liquid is recovered to the treatment liquid storage section 16 by the return side roller with cells 22. In this way, the treatment liquid remaining on the application roller 11 is recovered, and precipitation (separation) of the treatment liquid on the surface of the application roller 11 can be prevented. This operation corresponds to the step of residual treatment liquid recovery (step S24 in FIG. 7) which is already described in relation to the flowchart in FIG. 7.

The operation of recovering the residual treatment liquid from the surface of the roller should be carried out in accordance with requirements, from the viewpoint of preventing precipitation (separation) of the treatment liquid. If the next application operation is to be carried out within a short period of time, for instance, as in the case of continuous printing (continuous application) onto a plurality of sheets, or the like, it is not necessary to carry out recovery of the residual treatment liquid after application to each sheet. It is efficient to control the implementation of the recovery operation to circumstances where idle time of a prescribed time period is anticipated, for instance, at the end of continuous printing, or while awaiting the input of a print job, or the like. The allowable idle time period is set in accordance with the properties of the treatment liquid, such as the volatility of the treatment liquid, the stability of the constituent components, and the like.

3. Printing Operation Idle Mode

When the printing operation is idle, after the execution of the "maintenance mode immediately after the end of printing" described above, the rotation of all of the rollers (11, 20, 22) is halted, and no treatment liquid remains on the surface of the application roller 11.

Further Embodiments

Instead of the rollers with cells 20, 22 described above, it is also possible to use grooved rollers.

Figure 10:
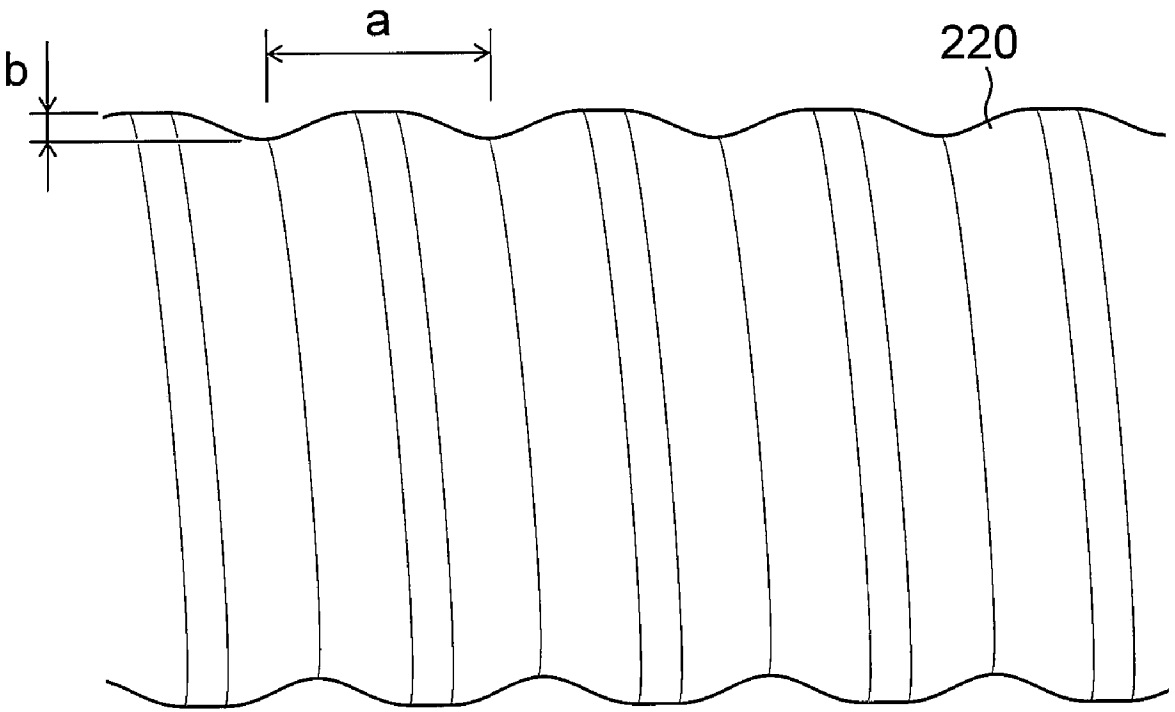
FIG. 10 is an enlarged diagram of the outer circumferential side of a roller with a spiral groove.

FIG. 10 is an enlarged diagram of the outer circumferential surface of a roller 220 formed with spiral grooves. This spiral grooved roller 220 is a roller which is formed with liquid holding grooves (indentations) substantially following the direction of rotation of the roller, by carrying out the rolling dies or wrapping a wire about the outer circumferential surface of the roller, or the like.

The shape, pitch a and depth b of the grooves in the spiral roller 220 are selected appropriately in accordance with the amount of liquid that is to be applied (the thickness of the liquid film after application).

Figure 11A:
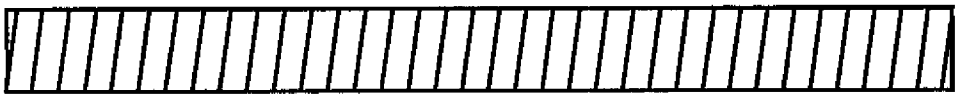
FIGS. 11A to 11C are illustrative diagrams illustrating examples of the shape of grooves in a grooved roller.
Figure 11B:
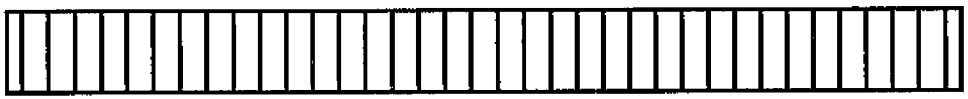
Figure 11C:
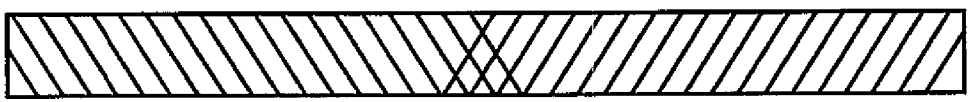
Figure 12A:
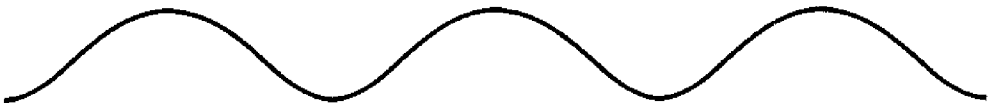
FIGS. 12A to 12D are illustrative diagrams illustrating examples of the cross-sectional shape of the outer circumferential side of a grooved roller.
Figure 12B:
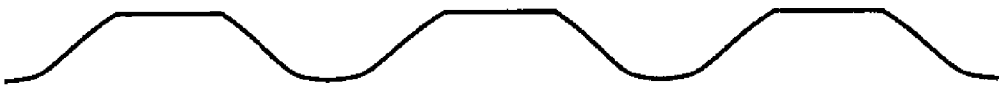
Figure 12C:
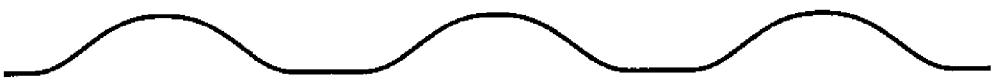
Figure 12D:
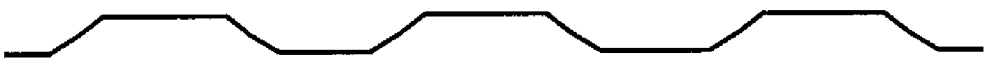

FIGS. 11A to 11C are schematic drawings illustrating examples of the shape of grooves in a grooved roller. In FIGS. 11A to 11C, in order to aid understanding of the shape of the grooves, the groove shape and the groove pitch, and the like, are depicted in a simplified fashion. As illustrated in FIGS. 11A to 11C, the groove shape may be, apart from a spiral shape as illustrated in FIG. 11A, an independent groove configuration (FIG. 11B), a left/right groove configuration (FIG. 11C), or a multi-column spiral configuration (not illustrated), or the like.

FIGS. 12A to 12D are schematic drawings illustrating the cross-sectional shape of the outer circumferential surface of a grooved roller (namely, the cross-section in a plane parallel to the roller axis). As illustrated in FIGS. 12A to 12D, the cross-sectional shape of the outer circumferential surface may be, apart from the S-shaped curved surface illustrated in FIG. 12A, a shape with flattened peaks (FIG. 12B) or flattened troughs (FIG. 12C), or a shape which has flattened peaks and flattened troughs (FIG. 12D), or the like. In particular, if the peak sections are flattened, then the wear resistance properties are improved, and furthermore, if the trough sections are flattened, then a large amount of liquid enters into the grooves and hence a large amount of liquid can be made to adhere to the outer circumferential surface of the roller.

The embodiments described above relates to an example of application to an inkjet recording apparatus for printing, but the scope of application of the present invention is not limited to the embodiments. For instance, it can also be applied widely to other apparatuses which obtain various shapes and patterns by using a liquid functional material, such as a wiring printing apparatus which prints a wiring pattern for an electronic circuit, and a fine structure forming apparatus which forms a fine structure by using a material deposition substance.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid application apparatus, comprising:

an application roller having an application surface for applying a liquid to a medium, at least the application surface of the application roller being constituted by an elastic body;

a liquid holding unit including an abutting part which abuts against a circumferential surface of the application roller so as to form a liquid holding space from which the liquid is supplied to the application surface, the abutting part having a measuring roller which is situated on a downstream side in terms of a direction of rotation of the application roller and has a projection-recess surface capable of holding a specific amount of the liquid;

a recovery roller in the abutting part to seal the liquid holding unit against the application roller;

a drive control device which rotates the application roller and the measuring roller in such a manner that the liquid is transferred from the application surface to the medium while the liquid is supplied to the application surface from the liquid holding unit, and which halts rotation of the measuring roller while rotating the application roller after an end of application of the liquid to the medium a driving device, separate from the drive control device or computer system for rotating the application roller and the measuring roller; and a brake device in communication with the measuring roller to halt rotation of the measuring roller.

2. The liquid application apparatus as defined in claim 1, wherein the measuring roller rotates following the rotation of the application roller when a braking action by the brake device is released.

3. The liquid application apparatus as defined in claim 1, wherein after the end of the application of the liquid to the medium, the drive control device controls the driving device to rotate the application roller at least by 360 degrees in a state where the rotation of the measuring roller is halted so as to recover the liquid remaining on the circumferential surface of the application roller into the liquid holding unit.

4. The liquid application apparatus as defined in claim 1, wherein the measuring roller is a roller whose surface has cells for holding the liquid, or a roller whose surface has a groove for holding the liquid.

5. The liquid application apparatus as defined in claim 1, wherein the recovery roller is situated on an upstream side in terms of the direction of the rotation of the application roller and has a projection-recess surface capable of holding a specific amount of the liquid.

6. The liquid application apparatus as defined in claim 5, wherein the recovery roller is a roller whose surface has cells for holding the liquid, or a roller whose surface has a groove for holding the liquid.

7. An image forming apparatus, comprising:

the liquid application apparatus as defined in claim 1 which applies a first liquid to a medium; and a liquid ejection head which ejects droplets of a second liquid to the medium to which the first liquid has been applied by the liquid application apparatus.

8. The image forming apparatus as defined in claim 7, wherein the second liquid is an ink containing coloring material, and the first liquid is an aggregating agent which causes the coloring material to aggregate.

* * * * *